US009507324B2

(12) United States Patent
Guo et al.

(10) Patent No.: US 9,507,324 B2
(45) Date of Patent: Nov. 29, 2016

(54) SMART WATCH

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Renwei Guo, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 29 days.

(21) Appl. No.: 14/555,779

(22) Filed: Nov. 28, 2014

(65) Prior Publication Data

US 2016/0026155 A1 Jan. 28, 2016

(30) Foreign Application Priority Data

Jul. 25, 2014 (CN) ..... 2014 1 0360503

(51) Int. Cl.
*G04C 19/00* (2006.01)
*G04B 19/00* (2006.01)
(Continued)

(52) U.S. Cl.
CPC ..... *G04G 17/045* (2013.01); *A44C 5/02* (2013.01); *A44C 5/105* (2013.01); *A44C 5/14* (2013.01);
(Continued)

(58) Field of Classification Search
CPC ..... A44C 5/00; A44C 5/02; A44C 5/105; A44C 5/14; A44C 5/2057; A44C 5/2066; A44C 5/2071; A44C 5/24; G04B 37/14; E05D 3/022; Y10T 16/54025; Y10T 16/540253; Y10T 16/54028; Y10T 16/5409; Y10T 16/54095
USPC ..... 368/82–84, 223, 239, 241, 242, 281, 368/282
See application file for complete search history.

(56) References Cited

U.S. PATENT DOCUMENTS 2,461,693 A * 2/1949 McAloon ..... A44C 5/14 24/265 B
2,820,275 A * 1/1958 Lancaster ..... G04B 37/12 224/174
(Continued)

FOREIGN PATENT DOCUMENTS

CN 1325041 A 12/2001
CN 201210237 Y 3/2009
(Continued)

OTHER PUBLICATIONS

1st office action issued in corresponding Chinese application No. 201410360503.X dated May 17, 2016.

*Primary Examiner* — Amy Cohen Johnson
*Assistant Examiner* — Daniel Wicklund
(74) *Attorney, Agent, or Firm* — Nath, Goldberg & Meyer; Joshua B. Goldberg

(57) ABSTRACT

A smart watch is provided, which is used for being worn on a wrist part and includes a main body part, wherein the main body part includes a main display screen used for displaying an operation interface, an auxiliary display screen used for displaying time and a connection display part connected with the main display screen and the auxiliary display screen, the main display screen and the auxiliary display screen are both rigid, and the connection display part is flexible, such that after the smart watch is worn on the wrist part, an angle may be formed between the display surface of the main display screen and the display surface of the auxiliary display screen. The smart watch is convenient for a user to read time, which provides a new choice for users and meets the demand of market diversification.

14 Claims, 10 Drawing Sheets

(51) Int. Cl.

| | |
|---|---|
| ***G04C 17/00*** | (2006.01) |
| ***G04G 17/04*** | (2006.01) |
| ***G04G 9/06*** | (2006.01) |
| ***A44C 5/10*** | (2006.01) |
| ***A44C 5/14*** | (2006.01) |
| ***G04G 9/00*** | (2006.01) |
| ***G04B 37/14*** | (2006.01) |
| ***A44C 5/02*** | (2006.01) |
| ***G04G 9/12*** | (2006.01) |

(52) U.S. Cl.

CPC ..... *G04B 37/14* (2013.01); *G04G 9/0023* (2013.01); *G04G 9/0029* (2013.01); *G04G 9/06* (2013.01); *G04G 9/12* (2013.01); *Y10T 16/5409* (2015.01); *Y10T 16/54025* (2015.01)

(56) References Cited

U.S. PATENT DOCUMENTS 4,412,751 A * 11/1983 Jeannet ..... G04G 17/083 368/204
4,935,996 A * 6/1990 Ferrara ..... A44B 11/2596 24/33 R
5,951,193 A * 9/1999 Yamamoto ..... A44C 5/105 24/265 B
6,317,928 B1 * 11/2001 Guillemette ..... E05D 7/1016 16/353
6,415,483 B1 * 7/2002 Dang ..... A44C 5/185 24/265 R
6,693,692 B1 * 2/2004 Kaneko ..... G02F 1/133553 349/114
7,408,846 B2 * 8/2008 Brodmann ..... A44C 5/0092 368/228
7,568,263 B2 * 8/2009 Kim ..... G04B 37/1486 24/265 B
2002/0012292 A1 * 1/2002 Mitamura ..... A44C 5/0015 368/281
2002/0104200 A1 * 8/2002 Iguchi ..... A44C 5/0007 24/265 WS
2003/0026171 A1 * 2/2003 Brewer ..... G02B 26/026 368/82
2005/0253358 A1 * 11/2005 Chen ..... H04M 1/0218 280/287
2011/0056241 A1 * 3/2011 Li ..... A44C 7/00 63/12
2015/0003210 A1 * 1/2015 Joung ..... G04G 17/00 368/10
2015/0192903 A1 * 7/2015 Vondle ..... G04G 17/08 368/317

FOREIGN PATENT DOCUMENTS

| | | | |
|---|---|---|---|
| CN | 202600380 | U | 12/2012 |
| CN | 203164610 | U | 8/2013 |
| CN | 103337478 | A | 10/2013 |
| CN | 103760758 | A | 4/2014 |
| WO | 2006/136587 | A2 | 12/2006 |

* cited by examiner

SMART WATCH

FIELD OF THE INVENTION

The present invention relates to the field of display devices, and in particular to a smart watch.

BACKGROUND OF THE INVENTION

Mobile phones, computers, televisions and the like are the current mainstream display devices. With scientific and technological progresses, a smart watch capable of displaying is gradually developed. The smart watch is similar to a common watch in shape, and capable of being worn on the wrist of a user. The smart watch differs from the common watch in that the smart watch is capable of realizing other functions (for example, playing videos, displaying pictures, making and receiving phone calls and the like) besides displaying time.

The smart watches in the current market are simple in type and style, and incapable of meeting the demand of market diversification.

SUMMARY OF THE INVENTION

An object of the present invention is to provide a smart watch, which is capable of providing a new choice for consumers.

In order to realize the object above, the present invention provides a smart watch, which is used for being worn on the wrist part and comprises a main body part, wherein the main body part comprises a main display screen used for displaying an operation interface, an auxiliary display screen used for displaying time and a connection display part connected with the main display screen and the auxiliary display screen. The main display screen and the auxiliary display screen are both rigid, and the connection display part is flexible, so that after the smart watch is worn on the wrist part, an angle may be formed between the display surface of the main display screen and the display surface of the auxiliary display screen.

Preferably, the length of the auxiliary display screen along the peripheral direction of the main body part is ⅕ to ¼ of the length of the main display screen along the peripheral direction of the main body part.

Preferably, the main display screen comprises a main rigid substrate and a main flexible underlayer arranged on the main rigid substrate, the auxiliary display screen comprises an auxiliary rigid substrate and an auxiliary flexible underlayer arranged on the auxiliary rigid substrate, the connection display part comprises a connection flexible underlayer, and the connection flexible underlayer is connected with the main flexible underlayer and the auxiliary flexible underlayer.

Preferably, the main flexible underlayer, the connection flexible underlayer and the auxiliary flexible underlayer are integrally formed.

Preferably, the main display screen further comprises a main pixel unit formed on the main flexible underlayer, the auxiliary display screen further comprises an auxiliary pixel unit formed on the auxiliary flexible underlayer, the main pixel unit comprises a plurality of main display pixels, and the auxiliary pixel unit comprises a plurality of auxiliary display pixels.

Preferably, a connection pixel unit electrically connecting the main pixel unit with the auxiliary pixel unit is arranged on the connection flexible underlayer, and the connection pixel unit comprises a plurality of connection display pixels.

Preferably, the shapes and dimensions of the main display pixels, the auxiliary display pixels and the connection display pixels are the same; or the dimensions and the shapes of the main display pixels and the auxiliary display pixels are the same, the length of the connection display pixels along the peripheral direction of the main body part is less than the length of the main display pixels, and the width of the connection display pixels along a direction vertical to the peripheral direction of the main body part is greater than or equal to the width of the main display pixels.

Preferably, the smart watch further comprises a drive circuit used for providing signals for the main display screen and the auxiliary display screen, and the drive circuit is arranged at one end of the main display screen, so that the main display screen is located between the drive circuit and the connection display part.

Preferably, the smart watch further comprises a protection shell coating the main body part, a first watch band and a second watch band. The protection shell comprises a transparent part, a first connection part and a second connection part. The transparent part is arranged at the light-emitting side of the smart watch and covers the main display screen and the auxiliary display screen. The first connection part is located at one end of the main display screen away from the auxiliary display screen and connected with the first watch band. The second connection part is located at one end of the auxiliary display screen away from the main display screen, and connected with the second watch band.

Preferably, the drive circuit is arranged on the first connection part.

Preferably, the smart watch further comprises a power supply unit. The first watch band comprises an installation part and a first buckling part, one end of the installation part is connected with the first connection part, the other end of the installation part is connected with the first buckling part. The power supply unit is arranged on the installation part and electrically connected with the drive circuit. An angle between the first buckling part and the installation part is adjustable.

The second watch band comprises a second buckling part, the second buckling part is connected with the second connection part, and an angle between the second buckling part and the second connection part is adjustable.

Preferably, one end of the installation part facing the first buckling part comprises a first bulged part, one end of the first buckling part facing the installation part comprises a second bulged part, and the first bulged part and the second bulged part are arranged in a staggered manner. A first hole penetrating through the first bulged part along the width direction of the first bulged part (that is, a direction vertical to the bulging direction of the first bulged part) is formed in the first bulged part, a second hole penetrating through the second bulged part along the width direction of the second bulged part (that is, a direction vertical to the bulging direction of the second bulged part) is formed in the second bulged part. The smart watch further comprises a first connection shaft, and the first connection shaft penetrates through the first hole and the second hole, thus connecting the first bulged part with the second bulged part.

The second connection part comprises a third bulged part bulging towards the second buckling part, and the second buckling part comprises a fourth bulged part bulging towards the second connection part. The third bulged part and the fourth bulged part are arranged in a staggered manner, a third hole penetrating through the third bulged part along the width direction of the third bulged part (that is, a direction vertical to the bulging direction of the third bulged part) is formed in the third bulged part, a fourth hole penetrating through the fourth bulged part along the width direction of the fourth bulged part (that is, a direction vertical to the bulging direction of the fourth bulged part) is formed in the fourth bulged part. The smart watch further comprises a second connection shaft, and the second connection shaft penetrates through the third hole and the fourth hole, thus connecting the third bulged part with the fourth bulged part.

Preferably, the first hole comprises a first fixation hole part and a first connection hole part which are coaxially formed, and the cross section of the first fixation hole part is a centrosymmetric equilateral polygon, wherein:

one end of the first fixation hole part is located on the side surface of the first bulged part departing from the second bulged part, one end of the first connection hole part is located on the side surface of the first bulged part facing the second bulged part, the other end of the first connection hole part is located at the other end of the first fixation hole part, and the cross section of the first connection hole part is circular; or one end of the first fixation hole part is located on the side surface of the first bulged part facing the second bulged part, one end of the first connection hole part is located on the side surface of the first bulged part departing from the second bulged part, and the other end of the first connection hole part is located at the other end of the first fixation hole part;

the second hole comprises a second fixation hole part and a second connection hole part which are coaxially arranged, one end of the second fixation hole part is located on the side surface of the second bulged part facing the first bulged part, and the cross section of the second fixation hole part is a centrosymmetric equilateral polygon, one end of the second connection hole part is located on the side surface of the second bulged part departing from the first bulged part, the other end of the second connection hole part is located at the other end of the second fixation hole part, and the cross section of the second connection hole part is circular;

the first connection shaft comprises a first shaft body, and a first fixation element and a second fixation element which are fixed on the first shaft body, the diameter of the first shaft body is less than that of the first connection hole part, and the diameter of the first shaft body is less than that of the second connection hole part, the shapes of the first fixation element and the first fixation hole part are matched, the shapes of the second fixation element and the second fixation hole part are matched, when the first fixation element is located in the first fixation hole part, the second fixation element is located in the second fixation hole part, and one end of the first shaft body extends to exceed the side surface of the second bulged part departing from the first bulged part.

Preferably, the third hole comprises a third fixation hole part and a third connection hole part which are coaxially formed, and the cross section of the third fixation hole part is a centrosymmetric equilateral polygon, wherein:

one end of the third fixation hole part is located on the side surface of the third bulged part departing from the fourth bulged part, one end of the third connection hole part is located on the side surface of the third bulged part facing the fourth bulged part, the other end of the third connection hole part is located at the other end of the third fixation hole part, and the cross section of the third connection hole part is circular; or, one end of the third fixation hole part is located on the side surface of the third bulged part facing the fourth bulged part, one end of the third connection hole part is located on the side surface of the third bulged part departing from the fourth bulged part, the other end of the third connection hole part is located at the other end of the third fixation hole part;

the fourth hole comprises a fourth fixation hole part and a fourth connection hole part which are coaxially arranged, one end of the fourth fixation hole part is located on the side surface of the fourth bulged part facing the third bulged part, and the cross section of the fourth fixation hole part is a centrosymmetric equilateral polygon, one end of the fourth connection hole part is located on the side surface of the fourth bulged part departing from the third bulged part, the other end of the fourth connection hole part is located at the other end of the fourth fixation hole part, and the cross section of the fourth connection hole part is circular; and the second connection shaft comprises a second shaft body, and a third fixation element and a fourth fixation element which are fixed on the second shaft body, the diameter of the second shaft body is less than that of the third connection hole part and less than that of the fourth connection hole part, the shapes of the third fixation element and the third fixation hole part are matched, the shapes of the fourth fixation element and the fourth fixation hole part are matched, when the third fixation element is located in the third fixation hole part, the fourth fixation element is located in the fourth fixation hole part, the second shaft body is located in the third connection hole part and the fourth connection hole part, and one end of the second connection shaft extends to exceed the side surface of the fourth bulged part departing from the third bulged part.

Preferably, a transparent cover plate is arranged above the transparent part.

Preferably, the smart watch further comprises a touch-control panel arranged on the light-outputting surface of the transparent part.

Preferably, after the smart watch is worn on the wrist part, the main display screen is located on the surface of the hand back side of the wrist part, and the auxiliary display screen is located at the radius of the wrist part.

The present invention provides a smart watch convenient for a user to read time, which provides a new choice for users and meets the demand of market diversification.

BRIEF DESCRIPTION OF THE DRAWINGS

The accompanying drawings are used for showing the exemplary implementation modes of the present invention. The accompanying drawings form a part of the description, but do not form limits to the present invention. In the accompanying drawings.

In the description, the same reference number/sign shows the same or similar device/part, in which, "1" is main pixel unit; "2" is connection pixel unit; "3" is auxiliary pixel unit; "4" is loudspeaking hole; "5" is display lamp; "6" is camera hole; "100" is main display screen; "110" is main rigid substrate; "120" is main flexible underlayer; "130" is main cell aligning substrate; "200" is auxiliary display screen; "210" is auxiliary rigid substrate; "220" is auxiliary flexible underlayer; "230" is auxiliary cell aligning substrate; "300" is connection display part; "310" is first watch band; "310*a*" is installation part; "310*b*" is first buckling part; "311*a*" is first bulged part; "311*b*" is second bulged part; "312*a*" is first fixation hole part; "312*b*" is second fixation hole part; "320" is second watch band; "400" is drive circuit; "500" is power supply unit; "610" is transparent part; "620" is first connection part; "630" is second connection part; "700" is transparent cover plate; "800" is first connection shaft; "810" is first fixation element; "820" is second fixation element; "830" is first shaft body; "A" is connection flexible underlayer; "C" is connection cell aligning substrate; "D" is laser emitting device; "E" is human eyes; "F" is connection rigid substrate; "W" is wrist part.

DETAILED DESCRIPTION OF THE EMBODIMENTS

The specific implementation modes of the present invention will be described in details below in combination with the accompanying drawings. It should be understood that, the described specific implementation modes herein are merely used for describing and understanding the present invention, rather than limiting the present invention.

Figure 1:
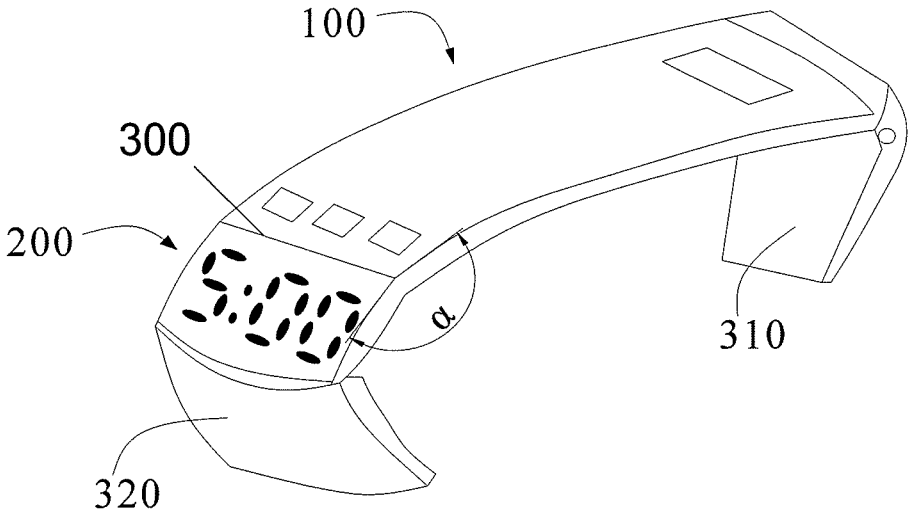
FIG. 1 is a schematic structural perspective view of a smart watch according to the present invention.
Figure 2:
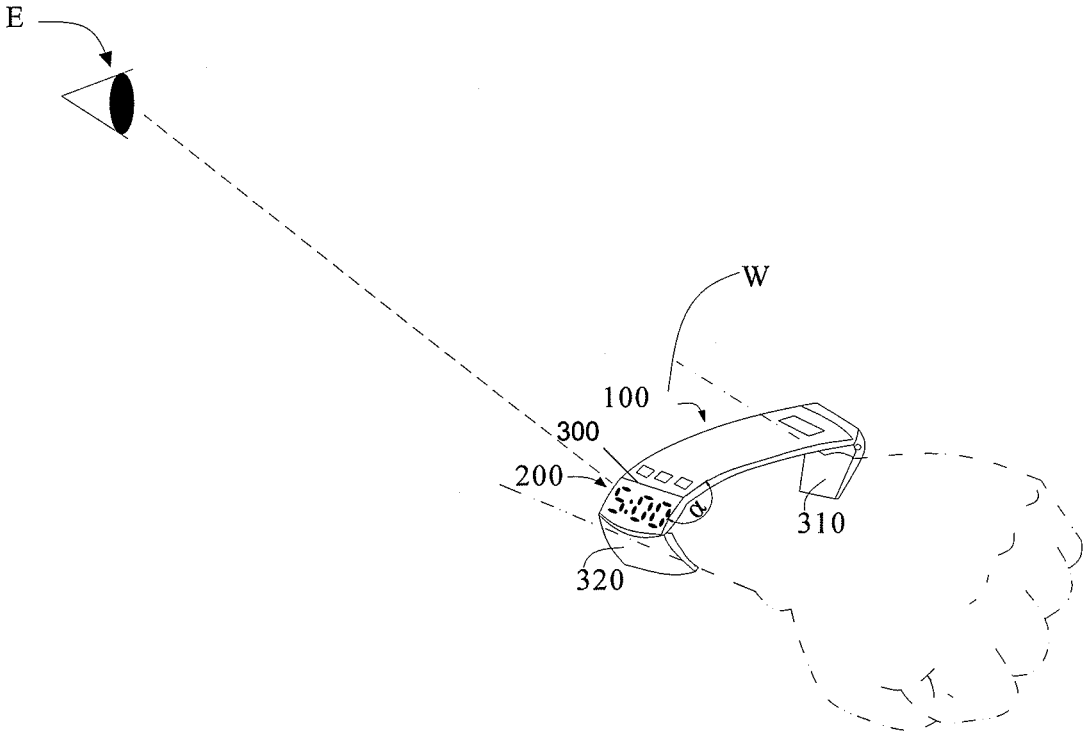
FIG. 2 is a schematic diagram in use state of the smart watch according to the present invention.

As one aspect of the present invention, as shown in FIGS. 1 to 3 and FIG. 4*l*, a smart watch is provided, and as shown in FIG. 2, the smart watch is used for being worn on the wrist part W. The smart watch comprises a main body part, wherein the main body part comprises a main display screen 100 used for displaying an operation interface, an auxiliary display screen 200 used for displaying time and a connection display part 300 connecting the main display screen 100 and the auxiliary display screen 200. The main display screen 100 and the auxiliary display screen 200 are both rigid, and the connection display part 300 is flexible, thus after the smart watch is worn on the wrist part W, an angle α may be formed between the display surface of the main display screen 100 and the display surface of the auxiliary display screen 200.

It should be understood that, the content that "an angle α 'can' be formed between the display surface of the main display screen 100 and the display surface of the auxiliary display screen 200" herein means that: when the smart watch is in a worn state (that is, the smart watch is worn by a user), an angle α is formed between the main display screen 100 and the auxiliary display screen 200. In order to increase the comfort degree of the user, preferably, when the smart watch is in a worn state, the angle α is an obtuse angle. When the smart watch is in a non-worn state, an angle α may or may not exist between the main display screen 100 and the auxiliary display screen 200.

It should be also understood that, the definition of the "angle α between the display surface of the main display screen 100 and the display surface of the auxiliary display screen 200" is that: when the display surfaces of the main display screen and the auxiliary display screen are both planar, the angle α between the display surface of the main display screen and the display surface of the auxiliary display screen is an angle between the display surface of the main display screen and the display surface of the auxiliary display screen; when the display surfaces of the main display screen and the auxiliary display screen are curved, the angle α between the display surface of the main display screen and the display surface of the auxiliary display screen is an included angle between a tangent plane of the main display screen at the middle position of its length in the peripheral direction of the smart watch and a tangent plane of the auxiliary display screen at the middle position of its length in the peripheral direction (i.e., direction of around the wrist W) of the smart watch; and when one of the display surfaces of the main display screen and the auxiliary display screen is curved, and the other one is planar, the angle α between the display surface of the main display screen and the display surface of the auxiliary display screen is an angle between a tangent plane of the curved surface at the middle position of its length in the peripheral direction (i.e., direction of around the wrist W) of the smart watch and the planar surface.

In an existing smart watch, an operation interface and time of the smart watch are displayed in the same screen, such that after the smart watch is worn by the user, the display screens are located on the surface of the palm side or the surface of the hand back side of the wrist part, and the wrist part usually needs to be turned when the user needs to look at the time. As shown in FIG. 2, in the smart watch according to the present invention, the auxiliary display screen 200 is located at one end of the main display screen 100, and the angle α between the display surface of the main display screen 100 and the display surface of the auxiliary display screen 200 is an obtuse angle. Therefore, when the smart watch is worn by the user, the main display screen 100 may be located on the surface of the hand back side of the wrist part W, and the auxiliary display screen 200 is located at the radius of the wrist part between the surface of the hand back side and the surface of the palm side of the wrist part W. When the user needs to look at the time, the time displayed on the auxiliary display screen 200 may be seen by lifting the wrist. In other words, the light ray emitted from the auxiliary display screen 200 may directly enter human eyes E without having to turn the wrist part, in such a manner that the user can more conveniently look at the time displayed on the auxiliary display screen 200 (the time shown in FIG. 2 is 5:00).

In addition, since the main display screen 100 and the auxiliary display screen 200 are both rigid, during the process of wearing the smart watch by the user, the main display screen 100 and the auxiliary display screen 200 are not inclined to deform. Therefore, the main pixel unit used for displaying the operation interface can be firmly and reliably arranged in the main display screen 100, and in the same way, the auxiliary pixel unit used for displaying the time can be firmly and reliably arranged in the auxiliary display screen 200. Since the connection display part 300 is flexible, the angle between the main display screen 100 and the auxiliary display screen 200 may not be fixed, thus increasing the comfort degree when the user wears the smart watch. In addition, by configuring the connection display part 300 to be flexible, separation between the main display screen 100 and the auxiliary display screen 200 may also be effectively prevented when the smart watch falls off.

As the processes of forming the connection display part 300 which will be described later, since the connection display part 300 is a ridge formed by folding the main display screen 100 with respect to the auxiliary display screen 200, the connection display part 300 is shown as a "linear" region which almost do not occupy any area in its peripheral direction, in FIGS. 1-3 and FIG. 4*l*.

The present invention provides a smart watch convenient for a user to read time, which provides a new choice for users and meets the demand of market diversification.

In the present invention, the main display screen 100 may be used for displaying the interface of an operation system, and many functions may be realized through the operation system. For example, the main display screen 100 may display videos, pictures, the interfaces of making and receiving phone calls, the interfaces of sending text messages, the interfaces of various applications, and the like.

Of course, on top of displaying time, the auxiliary display screen 200 may also display other contents. For example, when the smart watch is provided with a communication function, if the smart watch is receiving a phone call, then a call number may be displayed on the main display screen 100 and the auxiliary display screen 200 simultaneously; or, if the smart watch receives a text message, then a phone number where the text message is from may be displayed on the main display screen 100 and the auxiliary display screen 200 simultaneously, and the contents of the text message may be displayed on the auxiliary display screen 200 in a scrolling manner. The operator may see the phone number of the call or the text message only by lifting the wrist part W without turning the wrist. If the operator decides to answer the phone call or read the complete text message, he/she might turn the wrist part and operate the main display screen 100 on the surface of the hand back side of the wrist part W.

In order to facilitate the operation, the main display screen 100 may be provided with a touch-control function. Of course, the auxiliary display screen 200 may also be provided with a touch-control function. The main display screen 100 and the auxiliary display screen 200 may be liquid crystal screens, or OLED (Organic Light Emitting Diode) display screens or quantum dot light-emitting display screens.

Figure 3:
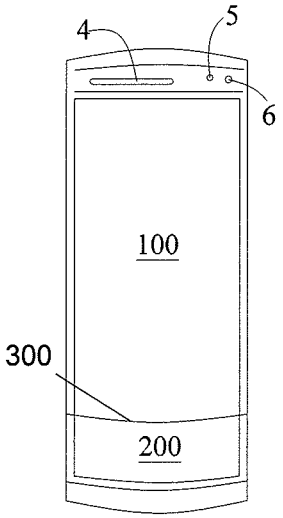
FIG. 3 is a schematic top view of the display screen of the smart watch shown in FIG. 1.

As shown in FIGS. 1 to 3, the widths of the main display screen 100 and the auxiliary display screen 200 may be the same. Preferably, the length of the auxiliary display screen 200 along the peripheral direction (i.e. direction of around a wrist) of the main body part 100 is ⅕ to ¼ of the length of the main display screen along the peripheral direction of the main body part, such that when the smart watch is worn by the user, the auxiliary display screen 200 is located at the radius of the user, and the wearing comfort degree is increased.

In the present invention, there are no specific limits to the specific structure of the main body part. For example, in order to facilitate manufacturing the main body part of the smart watch, preferably, as shown in FIG. 4*l*, the main body part 100 comprises a main rigid substrate 110 and a main flexible underlayer 120 arranged on the main rigid substrate 110, the auxiliary display screen 200 comprises an auxiliary rigid substrate 210 and an auxiliary flexible underlayer 220 arranged on the auxiliary rigid substrate 210, and the connection display part 300 comprises a connection flexible underlayer A which is used for connecting the main flexible underlayer 120 and the auxiliary flexible underlayer 220.

The main rigid substrate 110 and the auxiliary rigid substrate 210 are mainly used for providing a rigid support for the main body part 100 and the auxiliary display screen 200, respectively.

Further preferably, the connection flexible underlayer A, the connection flexible underlayer 120 and the auxiliary flexible underlayer 220 may be integrally formed. The advantage of integrally forming the connection flexible underlayer A, the connection flexible underlayer 120 and the auxiliary flexible underlayer 220 is introduced in details below.

In order to realize display, the main display screen 100 comprises a main array substrate, and the auxiliary display screen 200 comprises an auxiliary array substrate. Correspondingly, the main array substrate may comprise a main flexible underlayer 120 and a main pixel unit formed on the main flexible underlayer 120, and the main pixel unit comprises a plurality of main display pixels; and the auxiliary array substrate may comprise an auxiliary flexible underlayer 220 and an auxiliary pixel unit formed on the main flexible underlayer 220, and the auxiliary pixel unit may comprise a plurality of auxiliary display pixels. When the main flexible underlayer 120 and the auxiliary flexible underlayer 220 are integrally formed, the main flexible underlayer 120 and the auxiliary flexible underlayer 220 may be made from high-density polyimide (PI).

In order to ensure more continuous display between the main display screen 100 and the auxiliary display screen 200, preferably, a connection pixel unit used for electrically connecting the main pixel unit and the auxiliary pixel unit may be arranged on the top surface of the connection flexible underlayer, and the connection pixel unit comprises a plurality of connection display pixels. In order to simplify the process, the main pixel unit, the auxiliary pixel unit and the connection pixel unit may be manufactured simultaneously.

Figure 8A:
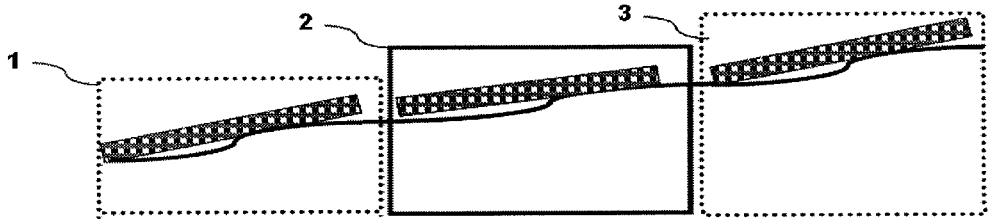
FIGS. 8*a* to 8*c* show schematic diagrams showing the combination of pixels with different lengths and the flexible underlayers.
Figure 8B:
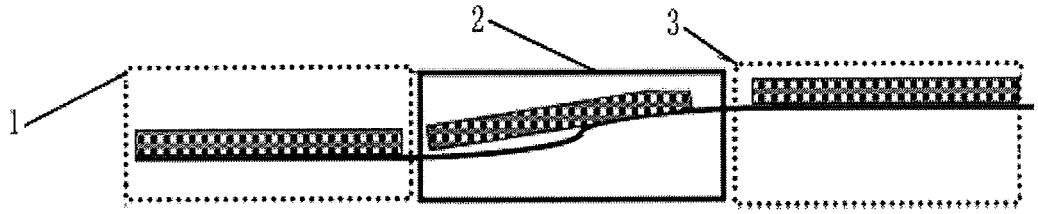
Figure 8C:
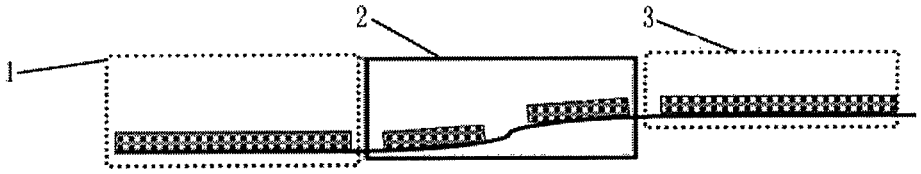

The other advantages brought by arranging the main rigid substrate 110 and the auxiliary rigid substrate 210 can be seen from FIGS. 8*a* to 8*c*. As shown in FIG. 8*a*, when the main display screen 100 does not comprise the main rigid substrate 110, the base of the main display screen may be not even enough, then the upper surface of the main flexible underlayer 120 is not even enough, causing that the joint between the main pixel unit arranged on the main flexible underlayer and the main flexible underlayer may be not close enough. As shown in FIG. 8*b* and FIG. 8*c*, when the main body part 100 comprises the main rigid substrate 110, the upper surface of the main flexible underlayer can be even enough, such that the main pixel unit arranged on the main flexible underlayer may be closely jointed with the main flexible underlayer. Similarly, the same advantages may be brought by arranging the auxiliary rigid substrate 210.

In the present invention, there are no special limits to the dimensions and shapes of the main display pixels, the auxiliary display pixels and the connection display pixels. In order to realize colour display, the main display pixels may comprise red sub-pixels R, green sub-pixels G and blue sub-pixels B, and so do the auxiliary display pixels and the connection display pixels.

Figure 7A:
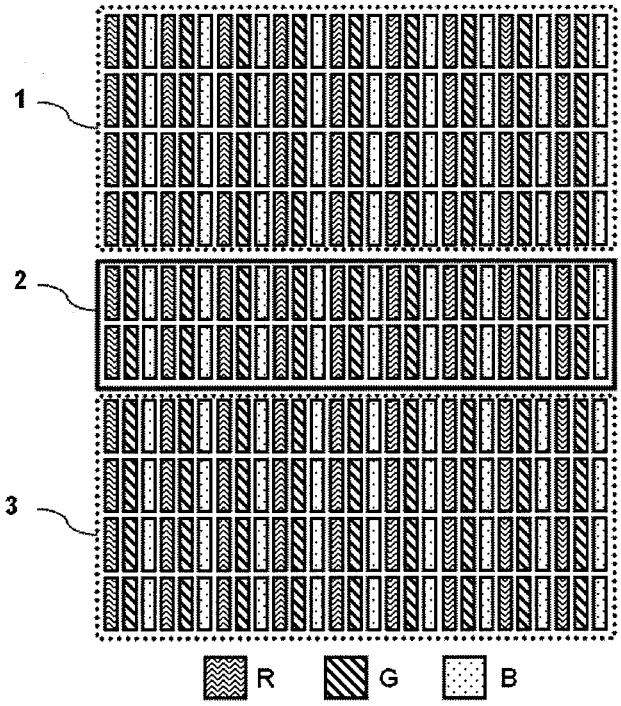
FIGS. 7*a* to 7*d* show four different implementation modes of the main pixel unit, the auxiliary pixel unit and the connection pixel unit.

For example, as shown in FIG. 7*a*, the dimensions and the shapes of the main display pixels in the main pixel unit 1, the connection display pixels in the connection pixel unit 2 and the auxiliary display pixels in the auxiliary pixel unit 3 are the same. When the main display pixels, the auxiliary display pixels and the connection display pixels shown in FIG. 7*a* are formed, the patterns of the parts corresponding to the main pixel unit 1, the connection pixel unit 2 and the auxiliary pixel unit 3, on a mask used for forming the main display pixels, the auxiliary display pixels and the connection display pixels are the same, that is, the dimensions of light-transmitting holes used for forming the various pixels are the same. Hence, when the main display pixels, the auxiliary display pixels and the connection display pixels are shown in FIG. 7*a*, the cost of machining a mask may be reduced.

As another implementation mode of the present invention, the dimensions and the shapes of the main display pixels and the auxiliary display pixels are the same, the length of the connection display pixels along the peripheral direction of the main body part (that is, a vertical direction in FIG. 7*b* to FIG. 7*d*) is less than the length of the main display pixels, and the width of the connection display pixels along a direction vertical to the peripheral direction of the main body part (that is, a transverse direction in FIG. 7*b* to FIG. 7*d*) is greater than or equal to the width of the main display pixels.

Figure 7B:
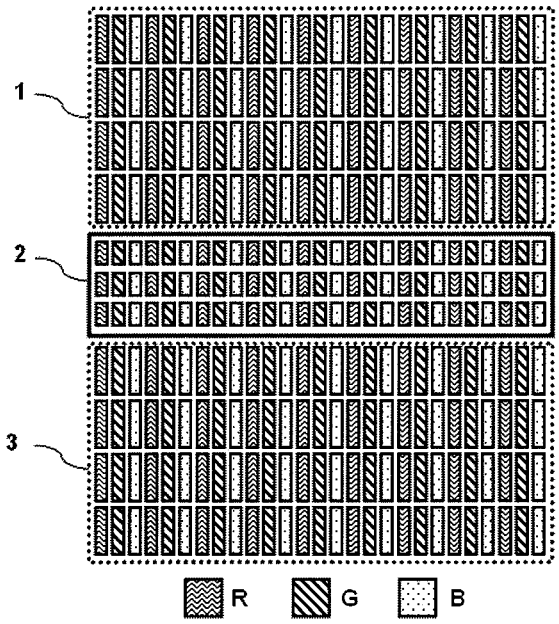
Figure 7C:
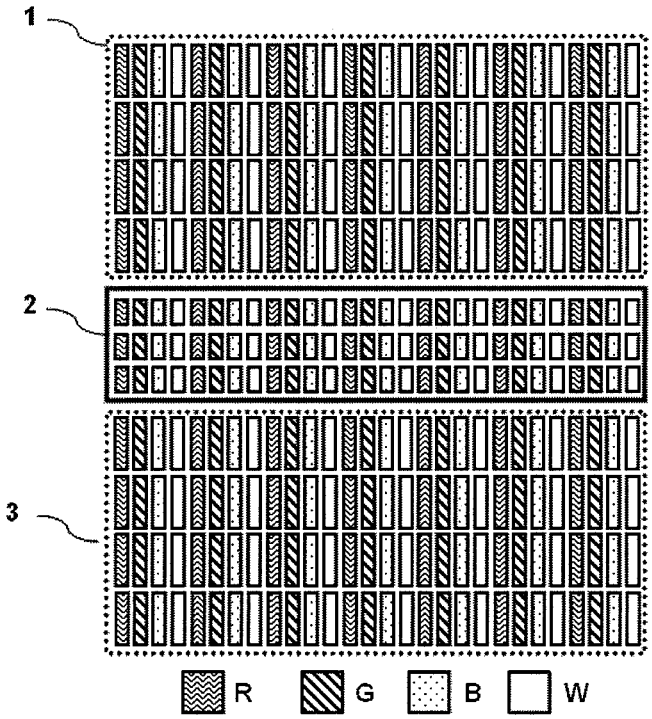

Specifically, in the case shown in FIGS. 7*b* to 7*c*, the width of the connection display pixels is equal to the width of the main display pixels. In the case shown in FIG. 7*d*, the width of the connection display pixels is greater than the width of the main display pixels.

As shown in FIG. 4*l*, at least when the smart watch is worn, the connection flexible underlayer A in the connection display part 300 is in a bent state, and the connection display pixels may be more reliably arranged on the connection flexible underlayer by reducing the length of the connection flexible underlayer. Specifically, it may be known from the comparison of FIG. 8*a*, FIG. 8*b* and FIG. 8*c* that, the smaller the length of the connection display pixels in the connection pixel unit 2 is, the higher the proportion of the contact area of each connection display pixel and the connection flexible underlayer A to the total area of the connection display pixels is, such that the connection display pixels may be firmly and reliably fixed on the connection flexible underlayer A.

Figure 7D:
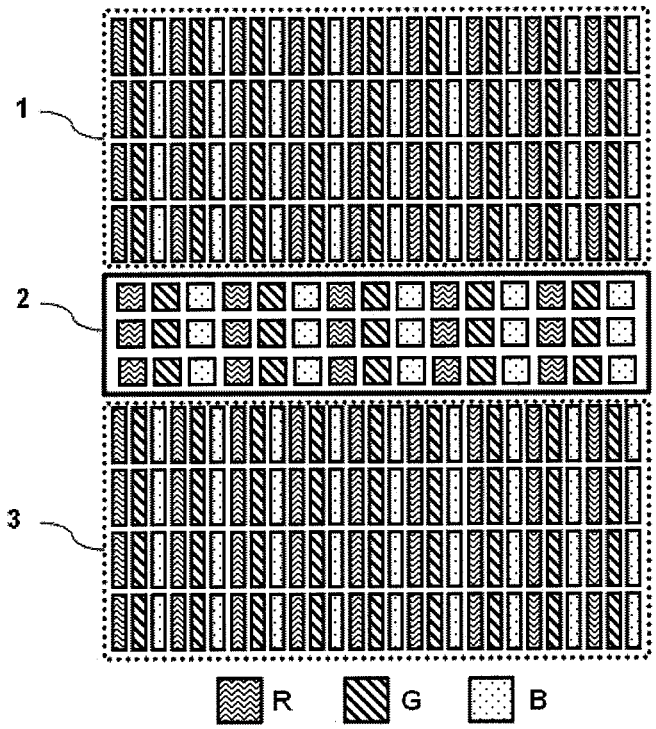

Since the connection display part 300 is almost not used for displaying high-resolution graphics, as shown in FIG. 7*d*, the connection display pixels may be formed into a shape of square, and the width of the connection display pixels is greater than the width of the main display pixels. It is easy to understand that the openings of the square connection display pixels shown in FIG. 7*d* are large, and the distance between the adjacent pixels is large, such that machining and manufacturing are facilitated.

FIGS. 7*a* and 7*b* show the case in which the main display pixels, the auxiliary pixels and the connection display pixels comprise red sub-pixels R, green sub-pixels G and blue sub-pixels B, respectively. As shown in FIG. 7*c*, the main display pixels, the auxiliary pixels and the connection display pixels may also comprise red sub-pixels R, green sub-pixels G, blue sub-pixels B and white sub-pixels W, respectively.

When the main display screen 100 is a liquid crystal screen, the main display pixels in the main pixel unit 1 may comprise a pixel unit encircled by the grid line and the data line of the liquid crystal display screen, and a thin film transistor, a pixel electrode, a common electrode and the like which are arranged in the pixel unit, so as to control liquid crystal molecules to rotate; and when the main display screen 100 is an OLED display screen, the main display pixels in the main pixel unit 1 may comprise a light-emitting element.

Similarly, when the auxiliary display screen 200 is a liquid crystal screen, the auxiliary display pixels in the auxiliary pixel unit 3 may comprise a pixel unit encircled by the grid line and the data line of the liquid crystal display screen, and a thin film transistor, a pixel electrode, a common electrode and the like which are arranged in the pixel unit, so as to control liquid crystal molecules to rotate; and when the auxiliary display screen 200 is an OLED display screen, the auxiliary display pixels in the auxiliary pixel unit 3 may comprise a light-emitting element.

Also similarly, when the connection display part 300 is a liquid crystal screen, the connection display pixels in the connection pixel unit 2 may comprise a pixel unit encircled by the grid line and the data line of the liquid crystal display screen, and a thin film transistor, a pixel electrode, a common electrode and the like which are arranged in the pixel unit, so as to control liquid crystal molecules to rotate; and when the connection display part 300 is an OLED display screen, the connection display pixels in the connection pixel unit 2 may comprise a light-emitting element.

It is easy to understand that, the main display screen 100 further comprises a main cell aligning substrate 130 formed with the main array substrate by virtue of cell aligning, the auxiliary display screen 200 further comprises an auxiliary cell aligning substrate 230 formed with the auxiliary array substrate by virtue of cell aligning, and the connection display part 300 further comprises a connection cell aligning substrate C formed with the connection array substrate by virtue of cell aligning. The main cell aligning substrate 130, the connection cell aligning substrate C and the auxiliary cell aligning substrate 230 may be integrally formed, and after the main pixel unit 1, the connection pixel unit 2 and the auxiliary pixel unit 3 are formed, the main display screen, the auxiliary display screen and the connection display part may be obtained through a one-step cell aligning process. Then the main display screen is rotated a certain angle relative to the auxiliary display screen, and then the relative positions of the main display screen and the auxiliary display screen are fixed.

In order to provide drive signals for the main display screen 100 and the auxiliary display screen 200, the smart watch may further comprise a drive circuit 400 used for providing signals for the main display screen and the auxiliary display screen. As a specific implementation mode of the present invention, the drive circuit 400 may be arranged at one end of the main display screen, such that the main display screen 100 is located between the drive circuit 400 and the connection display part 300. That is, the drive circuit 400 and the connection display part 300 are located at the opposite ends of the main display screen 100, respectively. By arranging the drive circuit 400 on the end part of the main display screen 100, it is benefited to realize a widescreen display of the main display screen 100.

In order to fix the relative angle between the main display screen 100 and the auxiliary display screen 200 and facilitate wearing, the smart watch comprises a protection shell coating the main body part, a first watch band 310 and a second watch band 320. The protection shell comprises a transparent part 610, a first connection part 620 and a second connection part 630. The transparent part 610 is arranged at the light-emitting side of the smart watch and covers the main display screen and the auxiliary display screen; the first connection part 620 is located at one end of the main display screen away from the auxiliary display screen, and connected with the first watch band 310; and the second connection part 630 is located at one end of the auxiliary display screen away from the main display screen, and connected with the second watch band 320.

The protection shell may fix the relative position between the main display screen 100 and the auxiliary display screen 200, that is, may guarantee that the angle α between the main display screen 100 and the auxiliary display screen 200 is an obtuse angle. The transparent part 610 is used for protecting the display surface of the main display screen 100 and the display surface of the auxiliary display screen 200, and free from influencing the display effects of the main display screen 100 and the auxiliary display screen 200. In the present invention, there are no special limits to the specific structures of the first watch band 310 and the second watch band 320, as long as the function of fixing the smart watch on the wrist part of the wearer may need to be exerted.

The protection shell may be configured to be transparent only at the transparent part 610, and the other parts may be configured to be various colours according to the hobby of the user.

It is easy to understand that, when the smart watch is arranged, the back surface of the smart watch (that is, the surface in contact with the wrist part of the wearer) may be configured to be a bent surface, such that when the smart watch is worn by the user, the back surface of the smart watch is fitted to the surface of the wrist part of the user, thus increasing the comfort degree of the smart watch. In the implementation mode that the smart watch comprises the protection shell, the surface of the protection shell in contact with the wrist part may be configured to be the surface matched with the surface of the wrist part in shape.

The smart watch according to the present invention may complete all the functions of a smart mobile phone. Therefore, as shown in FIG. 3, a loudspeaking hole 4, a camera module, a display lamp 5, a camera hole 6 and the like may be arranged on the first connection part 620.

In order to improve the aesthetic property of the smart watch, preferably, the first watch band 310 and the second watch band 320 may be provided with the structures shown in FIG. 1 and FIG. 4*l*. That is, the first watch band 310 and the second watch band 320 are both rigid, and after the first watch band 310 and the second watch band 320 are fixed on the first connection part 620 and the second connection part 630 of the protection shell respectively, a notch is formed between the tail end of the first connection part 620 and the tail end of the second connection part 630. When the smart watch is worn by the user, the first watch band 310 and the second watch band 320 are clamped on the wrist part of the user.

In order to save an installation space and increase the integration degree of the smart watch, the drive circuit 400 may be arranged on the first connection part 620.

The first watch band 310 may comprise an installation part 310*a* and a first buckling part 310*b*, one end of the installation part 310*a* is connected with the first connection part 620, and the other end of the installation part 310*a* is connected with the first buckling part 310*b*. The smart watch further comprises a power supply unit 500. The power supply unit 500 is arranged on the installation part 310*a* of the first watch band 310 and electrically connected with the drive circuit 400. An angle between the first buckling part 310*b* and the installation part 310*a* is adjustable.

The advantage of arranging the power supply unit 500 in the first watch band 310 lies in that the area of the power supply unit 500 in contact with the skin of the wearer can be reduced, therefore, the transfer of the heat generated by the power supply unit 500 to the wearer may be reduced, and the transfer of the own heat of the wearer to the power supply unit 500 may also be reduced. The advantage of configuring the angle between the first buckling part 310*b* and the installation part 310*a* to be adjustable lies in that the angle between the first buckling part 310*b* and the installation part 310*a* may be adjusted according to the thickness of the wrist part of the wearer, such that the smart watch is firmly worn on the wrist part of the wearer.

Correspondingly, the second watch band 320 comprises a second buckling part, the second buckling part is connected with the second connection part 630, and an angle between the second buckling part and the second connection part is adjustable.

Figure 5A:
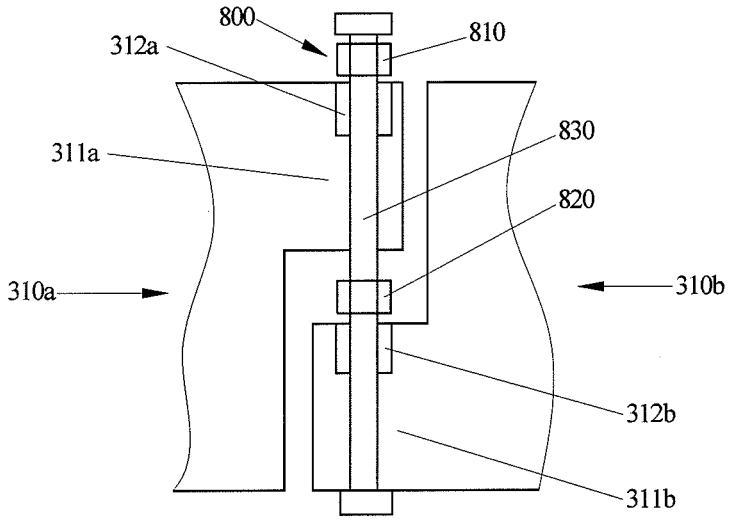
FIG. 5*a* shows the state in which the first buckling part is rotatable relative to the installation part in one embodiment of the present invention.
Figure 5B:
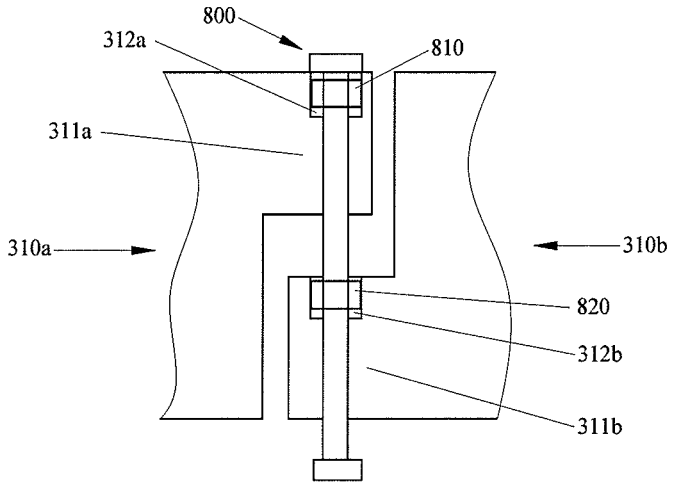
FIG. 5*b* shows the state in which the first buckling part is fixed relative to the installation part in one embodiment of the present invention.

The relationship between the first buckling part 310*b* and the installation part 310*a* of the first watch band 310 is described in details below in connection with FIGS. 5*a* to 6*b*. As shown in FIG. 5*a* and FIG. 5*b*, one end of the installation part 310*a* facing the first buckling part 310*b* comprises a first bulged part 311*a*, one end of the first buckling part 310*b* facing the installation part 310*a* comprises a second bulged part 311*b*, and the first bulged part 311*a* and the second bulged part 311*b* are arranged in a staggered manner. A first hole penetrating through the first bulged part 311*a* along the width direction of the first bulged part 311*a* (that is, a vertical direction in FIG. 5*a* and FIG. 5*b*) is formed in the first bulged part 311*a*. In the same way, a second hole penetrating through the second bulged part 311*b* along the width direction of the second bulged part 311*b* is formed in the second bulged part 311*b*. The smart watch further comprises a first connection shaft 800, which penetrates through the first hole and the second hole to connect the first bulged part 311*a* with the second bulged part 311*b*.

The staggering of the first bulged part 311*a* and the second bulged part 311*b* means that the first bulged part 311*a* and the second bulged part 311*b* are arranged in parallel, the first bulged part 311*a* is provided with a side surface facing the second bulged part 311*b* (that is, in FIG. 5*a* and FIG. 5*b*, the downward surface of the first bulged part 311*a*, which is shown as a line in FIG. 5*a* and FIG. 5*b*), and the second bulged part 311*b* is provided with a side surface facing the first bulged part 311*a* (that is, in FIG. 5*a* and FIG. 5*b*, the upward surface of the second bulged part 311*b*, which is shown as a line in FIG. 5*a* and FIG. 5*b*).

Correspondingly, the second watch band 320 may be provided with a structure similar with the structure of the first watch band 310 (which is not described in connection with the accompanying drawings here). Specifically, the second connection part may comprise a third bulged part bulging towards the second buckling part, the second buckling part comprises a fourth bulged part bulging towards the second connection part, and the third bulged part and the fourth bulged part are arranged in a staggered manner. A third hole penetrating through the third bulged part along the width direction of the third bulged part is formed in the third bulged part, a fourth hole penetrating through the fourth bulged part along the width direction of the fourth bulged part is formed in the fourth bulged part. The smart watch further comprises a second connection shaft, which penetrates through the third hole and the fourth hole to connect the third bulged part with the fourth bulged part.

The angle between the first buckling part 310*b* and the installation part 310*a* may be adjusted through many ways. For example, the smart watch may comprise a rigid fixed button, one end of the fixed button is arranged on the first buckling part 310*b*, and the other end of the fixed button is detachably arranged on the installation part 310*a*. After the angle between the first buckling part 310*b* and the installation part 310*a* is adjusted, the other end of the fixed button is fixed on the installation part 310*a*, thus preventing any one of the first buckling part 310*b* and the installation part 310*a* from continuing to rotate around the first connection shaft 800.

Figure 6A:
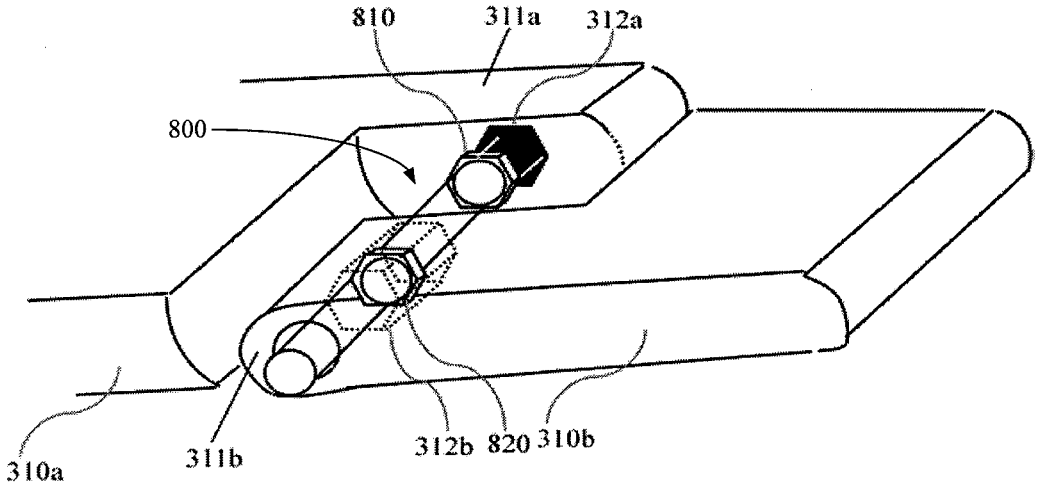
FIG. 6*a* shows the state in which the first buckling part is rotatable relative to the installation part in another embodiment of the present invention.
Figure 6B:
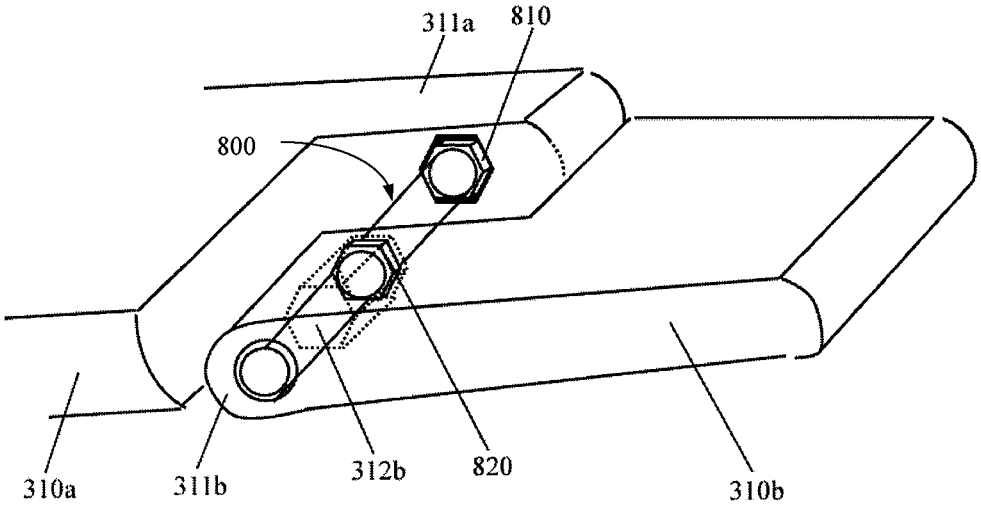
FIG. 6*b* shows the state in which the first buckling part is fixed relative to the installation part in another embodiment of the present invention.

As a preferred implementation mode of the present invention, as shown in FIG. 5*a* and FIG. 5*b*, the first hole may comprise a first fixation hole part 312*a* and a first connection hole part which are coaxially formed, one end of the first fixation hole part 312*a* is located on the side surface of the first bulged part 311*a* facing the second bulged part 311*b* (that is, the upward surface in FIG. 5*a* and FIG. 5*b*), and the cross section of the first fixation hole part 312*a* is a centrosymmetric equilateral polygon (as shown in FIG. 6*b*), one end of the first connection hole part is located on the side surface of the first bulged part departing from the second bulged part (that is, the downward surface in FIG. 5*a* and FIG. 5*b*), the other end of the first connection hole part is located at the other end of the first fixation hole part (that is, see from FIG. 5*a* and FIG. 5*b*, the first fixation hole part and the first connection hole part are formed as stepped holes, and the first fixation hole part is located above the first connection hole part), and the cross section of the first connection hole part is circular. Correspondingly, the second hole may comprise a second fixation hole part 312*b* and a second connection hole part, one end of the second fixation hole part 312*b* is located on the side surface of the second bulged part facing the first bulged part (that is, the upward surface in FIG. 5*a* and FIG. 5*b*), and the cross section of the second fixation hole part 312*b* is a centrosymmetric equilateral polygon. One end of the second connection hole part is located on the side surface of the second bulged part departing from the first bulged part (that is, the downward surface in FIG. 5*a* and FIG. 5*b*), the other end of the second connection hole part is located at the other end of the second fixation hole part, and the cross section of the second connection hole part is circular. The first connection shaft 800 comprises a first shaft body 830, and a first fixation element 810 and a second fixation element 820 which are fixed on the first shaft body 830, the diameter of the first shaft body 830 is less than that of the first connection hole part, and the diameter of the first shaft body 830 is less than that of the second connection hole part. The shapes of the first fixation element 810 and the first fixation hole part 312*a* are matched, and the shapes of the second fixation element 820 and the second fixation hole part 312*b* are matched. As shown in FIG. 5*b*, when the first fixation element 810 is located in the first fixation hole part 312*a*, the second fixation element 820 is located in the second fixation hole part 312*b*, and one end of the first shaft body extends to exceed the side surface of the second bulged part 311*b* departing from the first bulged part. The purpose of configuring the diameter of the first shaft body 830 to be less than the diameter of the first connection hole part and the diameter of the second connection hole part lies in that no interference connection is formed among the first shaft body, the first connection hole part and the second connection hole parts, such that the first buckling part 310*b* and the installation part 310*a* may oppositely rotate around the first shaft body 830.

When the first fixation hole part 312*a* and the second fixation hole part 312*b* are both centrosymmetric regular n-sided shapes, if the first buckling part 310*b* is rotated to enable the second fixation hole part 312*b* to round 360°/n around its own axis, then the second fixation hole part 312*b* and the first fixation hole part 312*a* are still completely aligned at this moment.

Specifically, as shown in FIG. 5*a*, when the angle between the installation part 310*a* and the first buckling part 310*b* needs to be adjusted, the first fixation element 810 is pulled out of the first fixation hole part 312*a*, and the second fixation element 820 is pulled out of the second fixation hole part 312*b*. Because the diameter of the first shaft body 830 is less than that of the first connection hole part and the diameter of the first shaft body 830 is less than that of the second connection hole part, the first buckling part 310*b* may rotate relative to the installation part 310*a* around the first shaft body 800. When the angle between the first buckling part 310*b* and the installation part 310*a* meets wearing requirements, then the first fixation element 810 may be pushed into the first fixation hole part 312*a*, and the second fixation element 820 may be pushed into the second fixation hole part 312*b*. Because the cross section of the first fixation element 810 and the cross section of the first fixation hole part 312*a* are both centrosymmetric equilateral polygons, and the cross section of the second fixation element 820 and the cross section of the second fixation hole part 312*b* are both centrosymmetric equilateral polygons, after the first fixation element 810 is pushed into the first fixation hole part 312*a* and the second fixation element 820 is pushed into the second fixation hole part 312*b*, the first buckling part 310*b* may not rotate relative to the installation part 310*a* around the first shaft body 800. Because when the first fixation element 810 is pushed into the first fixation hole part 312*a* and the second fixation element 820 is pushed into the second fixation hole part 312*b*, one end of the first shaft body 830 extends to exceed the side surface of the second bulged part 311*b* departing from the first bulged part, such that if it is desired to adjust the angle between the first buckling part 310*a* and the installation part 310*b* again, only one end of the first shaft body 830 stretching out from the second bulged part 311*b* is needed to be pushed towards the second bulged part 311*b*, such that the first fixation element 810 is separated from the first fixation hole part 312*a* and the second fixation element 820 is separated from the second fixation hole part 312*b*.

In the present invention, the first connection shaft 800 may be a bolt, and the first fixation element 810 and the second fixation element 820 may both be nuts capable of being screwed on the bolts, and in this case, the first fixation hole part 312*a* and the second fixation hole part 312*b* are both regular-hexagonal holes.

As another implementation mode of the present invention, the first buckling part 310*b* and the installation part 310*a* may also be provided with the structures shown in FIG. 6*a* and FIG. 6*b*.

The structures shown in FIG. 6*a* and FIG. 6*b* differ from the structures shown in FIG. 5*a* and FIG. 5*b* in that: one end of the first fixation hole part 312*a* is located on the side surface of the first bulged part 311*a* facing the second bulged part 311*b*, and one end of the first connection hole is located on the side surface of the first bulged part 311*a* departing from the second bulged part 311*b*. In FIG. 6*a*, the first fixation element 810 of the first connection shaft 800 is located outside the first fixation hole part 312*a*, and the second fixation element 820 of the first connection shaft 800 is located in the second fixation hole part 312*b*. Therefore, the first buckling part 310*b* is fixed relative to the first connection shaft 800, and the installation part 310*a* is capable of rotating relative to the first connection shaft 800. When the smart watch is in the state in FIG. 6*a*, the position of the first buckling part 310*b* relative to the installation part 310*a* may be adjusted. As shown in FIG. 6*b*, the first fixation element 810 of the first connection shaft 800 is located in the first fixation hole part 312*a*, the second fixation element 820 of the first connection shaft 800 is located in the second fixation hole part 312*b*, and at this moment, relative rotation cannot be carried out between the installation part 310*a* and the first buckling part 310*b*.

Correspondingly, in order to adjust the angle between the second connection part and the second buckling part, preferably, the second connection part comprises a third bulged part bulging towards the second buckling part, the second buckling part comprises a fourth bulged part bulging towards the second connection part, and the third bulged part and the fourth bulged part are arranged in a staggered manner. A third hole penetrating through the third bulged part along the width direction of the third bulged part is formed in the third bulged part, and a fourth hole penetrating through the fourth bulged part along the width direction of the fourth bulged part is formed in the fourth bulged part. The smart watch further comprises a second connection shaft, and the second connection shaft penetrates through the third hole and the fourth hole, thus connecting the third bulged part with the fourth bulged part.

Further preferably, the third hole comprises a third fixation hole part and a third connection hole part which are coaxially formed. One end of the third fixation hole part is located on the side surface of the third bulged part departing from the fourth bulged part, and the cross section of the third fixation hole part is a centrosymmetric equilateral polygon. One end of the third connection hole part is located on the side surface of the third bulged part facing the fourth bulged part, the other end of the third connection hole part is located at the other end of the third fixation hole part, and the cross section of the third connection hole part is circular. The fourth hole comprises a fourth fixation hole part and a fourth connection hole part which are coaxially formed. One end of the fourth fixation hole part is located on the side surface of the fourth bulged part facing the third bulged part, and the cross section of the fourth fixation hole part is a centrosymmetric equilateral polygon. One end of the fourth connection hole part is located on the side surface of the fourth bulged part departing from the third bulged part, the other end of the fourth connection hole part is located at the other end of the fourth fixation hole part, and the cross section of the fourth connection hole part is circular.

The second connection shaft comprises a second shaft body, and a third fixation element and a fourth fixation element which are fixed on the second shaft body, the diameter of the second shaft body is less than that of the third connection hole part, and less than that of the fourth connection hole part. The shapes of the third fixation element and the third fixation hole part are matched, and the shapes of the fourth fixation element and the fourth fixation hole part are matched. When the third fixation element is located in the third fixation hole part, the fourth fixation element is located in the fourth fixation hole part, and the second shaft body is located in the third fixation hole part and the fourth fixation hole part, and one end of the second connection shaft extends to exceed the side surface of the fourth bulged part departing from the third bulged part. The structures of the second connection part and the second buckling part are not repeatedly described in connection with the accompanying drawings, since the structures of the second connection part and the second buckling part are similar to the structures of the first connection part and the first buckling part, respectively.

Correspondingly, the second connection part and the second buckling part may also be provided with structures similar to the structures shown in FIG. 6*a* and FIG. 6*b*. That is, one end of the third fixation hole part on the third bulged part is located on the surface of the third bulged part facing the fourth bulged part, one end of the third connection hole part is located on the surface of the third bulged part departing from the fourth bulged part, the other end of the third connection hole part is located at the other end of the third fixation hole part.

The power supply unit 500 may be a common button cell. In order to save energy, the power supply unit 500 may also comprise a solar cell.

In order to further protect the main display screen 100 and the auxiliary display screen 200, a transparent cover plate 700 may be covered above the transparent part 610 of the protection shell. The transparent cover plate 700 may be a common glass cover plate or a resin cover plate, as long as no influence occurs on the display of the main display screen 100 and the auxiliary display screen 200.

When the main display screen 100 and the auxiliary display screen 200 are both OLED display screens, in order to realize touch-control operations on the main display screen and the auxiliary display screen, the smart watch may also comprise a touch-control panel arranged on the light-outputting surface of the transparent part 610. The touch-control panel forms an On-Cell touch-control display device with the main display screen and the auxiliary display screen.

As mentioned above, after the smart watch is worn on the wrist part W, the main display screen 100 is located on the surface of the hand back side of the wrist part, and the auxiliary display screen 200 is located at the radius of the wrist part. When the user needs to look at the time, the time displayed on the auxiliary display screen 200 may be seen only by lifting the wrist part. That is, the light ray emitted from the auxiliary display screen 200 may directly enter human eyes E, in such a manner that the user may conveniently know the time displayed by the auxiliary display screen 200 (the time shown in FIG. 2 is 5:00).

A manufacturing method for the smart watch according to the present invention is introduced below. As shown in FIG. 4*a* to FIG. 4*l*, the manufacturing method comprises the following steps:

forming a main body part, which comprises a main display screen 100 used for displaying an operation interface, an auxiliary display screen 200 used for displaying time and a connection display part 300 connected between the main display screen 100 and the auxiliary display screen 200. The main display screen and the auxiliary display screen are rigid, and the auxiliary display screen is arranged at one end of the main display screen. The connection display part 300 is flexible, such that after the smart watch is worn on the wrist part W, an angle, that is an obtuse angle, can be formed between the display surface of the main display screen 100 and the display surface of the auxiliary display screen 200.

In the present invention, there are no special limits to the specific process of forming the main body part, wherein the main array substrate of the main display screen may be formed through the traditional photoetching process, and then the main display screen is formed through the traditional cell aligning process; and in the same way, the auxiliary array substrate of the auxiliary display screen may be formed through the traditional photoetching process, and then the auxiliary display screen is formed through the traditional cell aligning process.

Figure 4A:
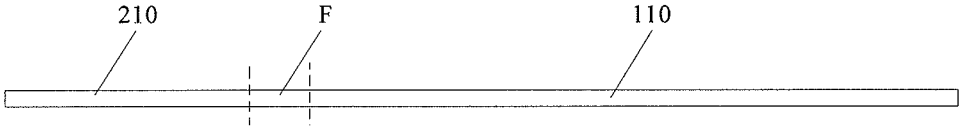
FIGS. 4*a* to 4*l* show various manufacturing steps for the smart watch according to the present invention.
Figure 4B:
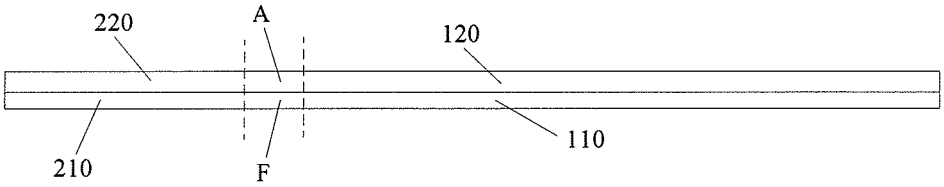
Figure 4C:
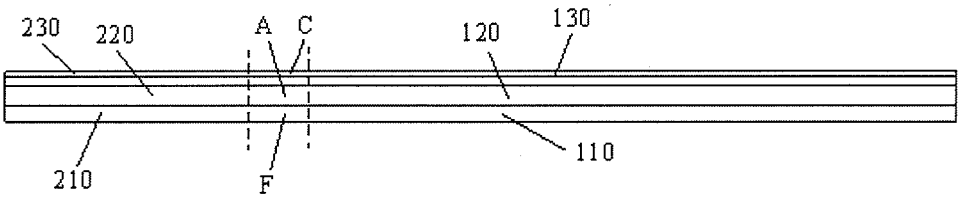
Figure 4D:
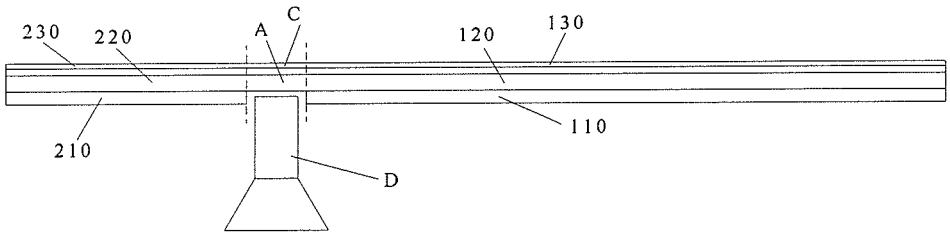
Figure 4E:
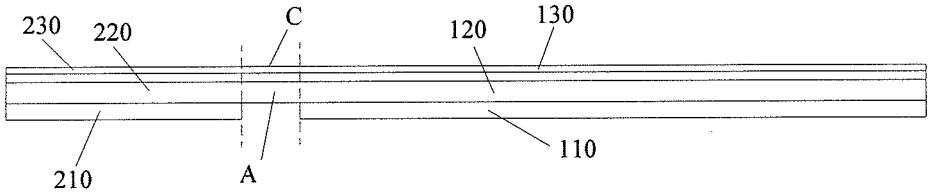
Figure 4F:
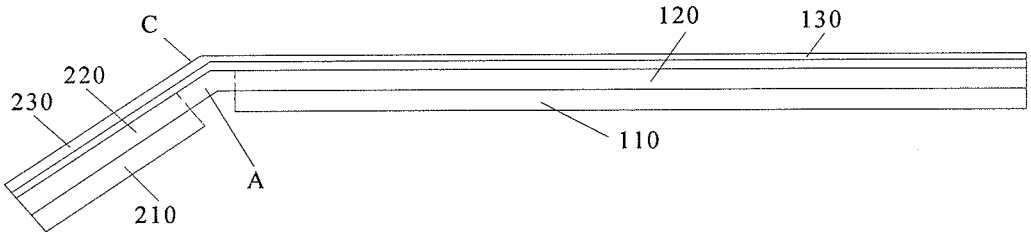

As a specific implementation mode of the present invention, the steps of forming the main body part comprise:

providing rigid substrates (as shown in FIG. 4*a*), the rigid substrates comprising a main rigid substrate 110 corresponding to the main display screen 100, an auxiliary rigid substrate 210 corresponding to the auxiliary display screen 200, and a connection rigid substrate F connected between the main rigid substrate 110 and the auxiliary rigid substrate 210;

forming flexible underlayers on the rigid substrates (as shown in FIG. 4*b*), the flexible underlayers comprising a main flexible underlayer 120 corresponding to the main display screen 100, an auxiliary flexible underlayer 220 corresponding to the auxiliary display screen 200, and a connection flexible underlayer A connected between the main flexible underlayer 120 and the auxiliary flexible underlayer 220 and corresponding to the connection display part 300;

forming pixel units on the flexible underlayers so as to obtain an array substrate, the pixel units comprising a main pixel unit corresponding to the main display screen, the auxiliary pixel unit corresponding to the auxiliary display screen, and the connection pixel unit corresponding to the connection part;

carrying out cell aligning on the array substrate and a cell aligning substrate (see FIG. 4*c*), the cell aligning substrate comprises a main cell aligning substrate 130 corresponding to the main display screen 100, an auxiliary cell aligning substrate 230 corresponding to the auxiliary display screen 200, and a connection cell aligning substrate C connected between the main cell aligning substrate 130 and the auxiliary cell aligning substrate 230 and corresponding to the connection part; and cutting off the connection rigid substrate F of the rigid substrates (as shown in FIG. 4*d* and FIG. 4*e*), and rotating the main rigid substrate 110 at the connection flexible underlayer A relative to the auxiliary rigid substrate 210 (as shown in FIG. 4*f*), so as to form the main display screen 100 used for displaying an operation interface, an auxiliary display screen 200 used for displaying time and a connection display part 300 connected with the main display screen and the auxiliary display screen.

In the step of cutting off the connection rigid substrate of the rigid substrates, the connection rigid substrate may be cut off by virtue of laser. For example, the connection rigid substrate F may be cut off by virtue of the laser beam generated by a laser emitting device D shown in FIG. 4*d*.

It may be known from the descriptions above, the advantage of forming the main flexible underlayer 120, the connection flexible underlayer A and the auxiliary flexible underlayer 220 to be an integrated structure lies in that the main pixel unit 1, the connection pixel unit 2 and the auxiliary pixel unit 3 may be formed simultaneously, thus simplifying the process of manufacturing the smart watch.

As a preferred implementation mode of the present invention, the smart watch further comprises a protection shell, a first watch band and a second watch band, therefore, the manufacturing method further comprises:

forming a protection shell coating the main body part, the protection shell comprising a transparent part 610, a first connection part 620 and a second connection part 630, the transparent part 610 covering the display surface of the main display screen and the display surface of the auxiliary display screen, the first connection part 620 being located at one end of the main display screen away from the auxiliary display screen, and the second connection part 630 being located at one end of the auxiliary display screen away from the main display screen; and arranging the first watch band 310 and the second watch band 320, the first watch band 310 being connected with the first connection part 620, and the second watch band 320 being connected with the second connection part 630 (see FIG. 4*l*).

In the present invention, the protection shell may be formed through various manners. For example, the protection shell may be pre-manufactured, and then the protection shell is assembled with the main body part.

Figure 4G:
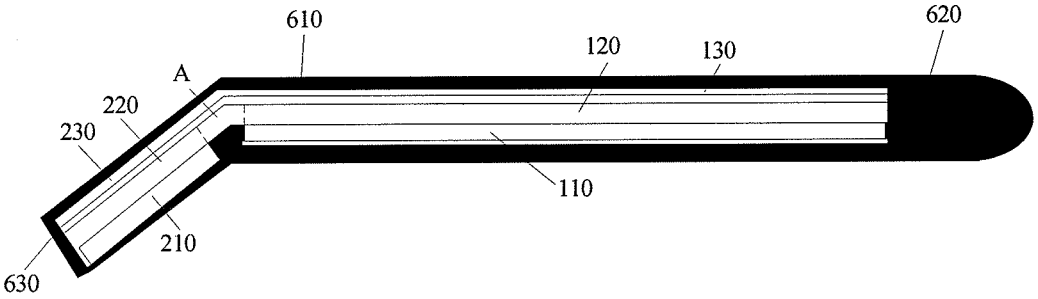
Figure 4H:
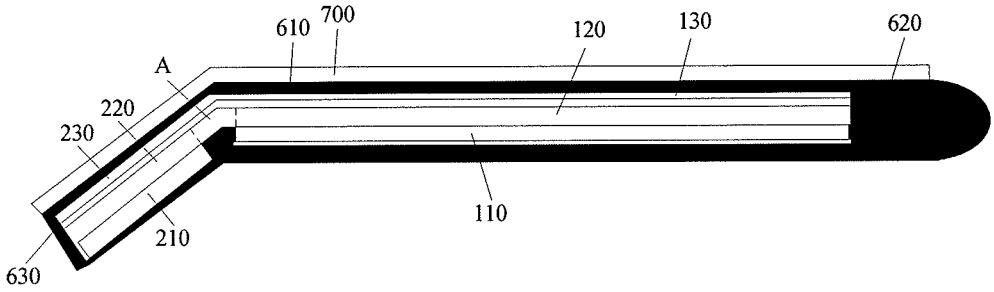

Or, as shown in FIG. 4*g*, the step of forming the protection shell of the main body part comprises:

coating a heat-sensitive material on the main body part; and heating the heat-sensitive material, so as to form the protection shell.

As mentioned above, the surface of the protection shell in contact with the wrist part may be configured to have a surface fitted to the surface of the wrist part in shape. In order to achieve the purpose, the main body part coated with the heat-sensitive material may be placed in a die and subjected to heating curing, and in this case, the cavity surface of the die have a curved surface fitted to the surface of the wrist part.

Figure 4I:
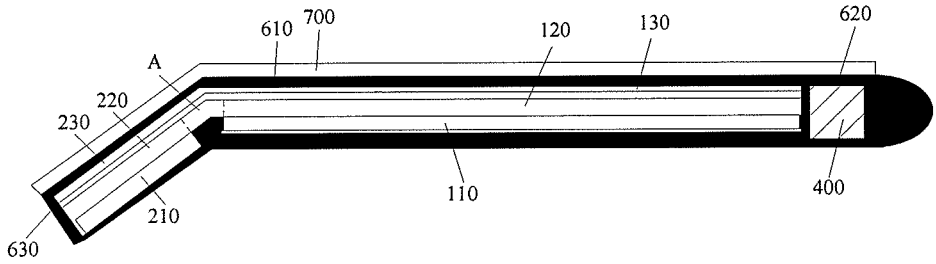
Figure 4J:
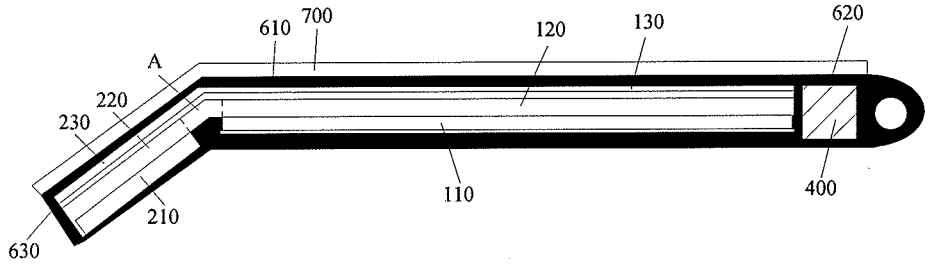
Figure 4K:
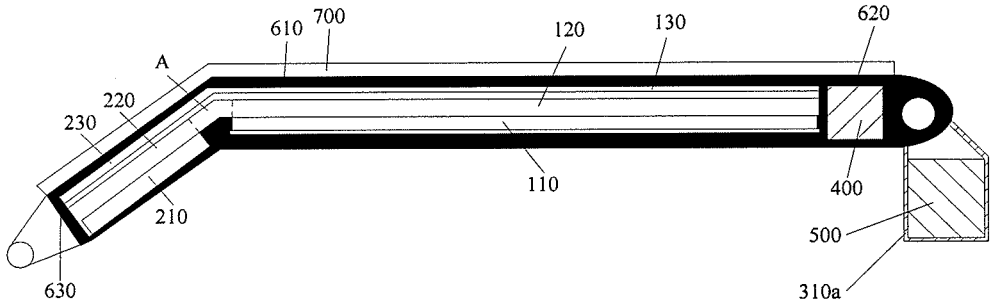
Figure 4L:
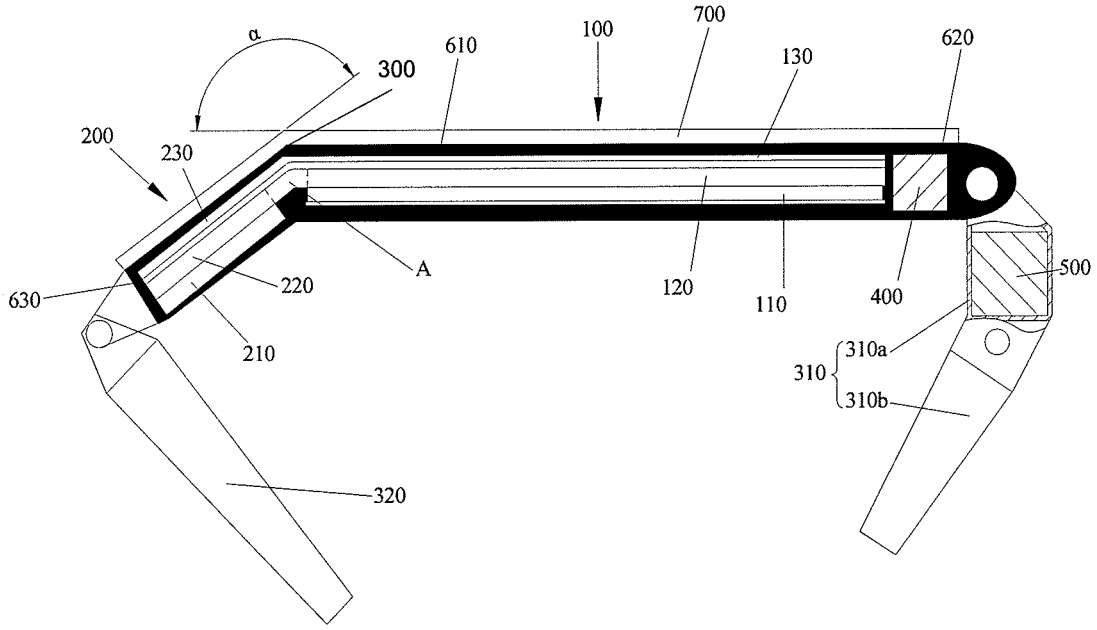

As mentioned above, the smart watch further comprises a drive circuit 400, the first watch band 310 comprises a first buckling part 310*b*, and an installation part 310*a* connected between the first buckling part 310*b* and the first connection part 620, and thus the manufacturing method further comprises:

arranging the drive circuit 400 in the first connection part 620 (as shown in FIG. 4*i*); and arranging the first watch band 310 connected with the first connection part 620, the first watch band 310 comprising a first buckling part 310*b*, and an installation part 310*a* connected between the first buckling part 310*b* and the first connection part 620, and then arranging a power supply unit 500 used for supplying power to the drive circuit 400 in the installation part 310*a* (see FIG. 4*k*).

Before the power supply unit 500 is arranged, an installation groove may be formed in the installation part 310*a* of the first watch band 310, and a connection circuit electrically connected with the drive circuit 400 is first arranged, and then the power supply unit 500 is arranged in the installation groove and enabled to be electrically connected with the drive circuit 400 through the connection circuit.

Preferably, the manufacturing method further comprises: forming a transparent cover plate 700 above the transparent part 610 (see FIG. 4*l*).

As mentioned above, the transparent cover plate 700 is used for protecting the display surface of the main display screen and the display surface of the auxiliary display screen from being worn.

As mentioned above, in order to realize touch-control operations on the smart watch, the manufacturing method further comprises: forming a touch-control panel above the transparent part 610. The touch-control panel may be any touch-control panel capable of being used for an ON-CELL touch display screen in the prior art, which is not repeatedly described here.

It can be understood that, the foregoing implementation modes are merely exemplary implementation modes adopted for illustrating the principle of the present invention, but the protection scope of the present invention is not limited thereto. Any variations and improvements could be made by those of ordinary skill in the art without departing from the spirit and essence disclosed in the present invention, and all the variations and improvements will fall within the protection scope of the present invention.

The invention claimed is:

1. A smart watch used for being worn on a wrist part, comprising a main body part, wherein the main body part comprises:

a main display screen used for displaying an operation interface;

an auxiliary display screen used for displaying time; and a connection display part connected with the main display screen and the auxiliary display screen, the main display screen and the auxiliary display screen are both rigid, and the connection display part is flexible, so that after the smart watch is worn on the wrist part, an angle may be formed between the display surface of the main display screen and the display surface of the auxiliary display screen, the smart watch further comprises a drive circuit used for providing signals for the main display screen and the auxiliary display screen, wherein the drive circuit is arranged at one end of the main display screen, so that the main display screen is located between the drive circuit and the connection display part, the smart watch further comprises: a protection shell coating the main body part; a first watch band; and a second watch band; wherein the protection shell comprises a transparent part, a first connection part and a second connection part; the transparent part is arranged at the light-emitting side of the smart watch and covers the main display screen and the auxiliary display screen, the first connection part is located at one end of the main display screen away from the auxiliary display screen and connected with the first watch band, and the second connection part is located at one end of the auxiliary display screen away from the main display screen and connected with the second watch band, the drive circuit is arranged on the first connection part, the smart watch further comprises a power supply unit, wherein the first watch band comprises an installation part and a first buckling part, one end of the installation part is connected with the first connection part, the other end of the installation part is connected with the first buckling part, the power supply unit is arranged on the installation part, and electrically connected with the drive circuit, and an angle between the first buckling part and the installation part is adjustable; and the second watch band comprises a second buckling part, the second buckling part is connected with the second connection part, and an angle between the second buckling part and the second connection part is adjustable, one end of the installation part facing the first buckling part comprises a first bulged part, one end of the first buckling part facing the installation part comprises a second bulged part, the first bulged part and the second bulged part are arranged in a staggered manner, a first hole penetrating through the first bulged part along a width direction of the first bulged part is formed in the first bulged part, a second hole penetrating through the second bulged part along a width direction of the second bulged part is formed in the second bulged part, the smart watch further comprises a first connection shaft, and the first connection shaft penetrates through the first hole and the second hole, thus connecting the first bulged part with the second bulged part; and the second connection part comprises a third bulged part bulging towards a second buckling part, the second buckling part comprises a fourth bulged part bulging towards the second connection part, the third bulged part and the fourth bulged part are arranged in a staggered manner, a third hole penetrating through the third bulged part along a width direction of the third bulged part is formed in the third bulged part, a fourth hole penetrating through the fourth bulged part along a width direction of the fourth bulged part is formed in the fourth bulged part, the smart watch further comprises a second connection shaft, and the second connection shaft penetrates through the third hole and the fourth hole, thus connecting the third bulged part with the fourth bulged part, the first hole comprises a first fixation hole part and a first connection hole part which are coaxially formed, and the cross section of the first fixation hole part is a centrosymmetric equilateral polygon, wherein one end of the first fixation hole part is located on the side surface of the first bulged part departing from the second bulged part one end of the first connection hole part is located on the side surface of the first bulged part facing the second bulged part the other end of the first connection hole part is located at the other end of the first fixation hole part, and the cross section of the first connection hole part is circular; or, one end of the first fixation hole part is located on the side surface of the first bulged part facing the second bulged part, one end of the first connection hole part is located on the side surface of the first bulged part departing from the second bulged part, and the other end of the first connection hole part is located at the other end of the first fixation hole part;

the second hole comprises a second fixation hole part and a second connection hole part which are coaxially arranged, one end of the second fixation hole part is located on the side surface of the second bulged part facing the first bulged part, and the cross section of the second fixation hole part is a centrosymmetric equilateral polygon, one end of the second connection hole part is located on the side surface of the second bulged part departing from the first bulged part, the other end of the second connection hole part is located at the other end of the second fixation hole part, and the cross section of the second connection hole part is circular;

the first connection shaft comprises a first shaft body, and a first fixation element and a second fixation element which are fixed on the first shaft body, a diameter of the first shaft body is less than that of the first connection hole part, and the diameter of the first shaft body is less than that of the second connection hole part, the shapes of the first fixation element and the first fixation hole part are matched, the shapes of the second fixation element and the second fixation hole part are matched, when the first fixation element is located in the first fixation hole part, the second fixation element is located in the second fixation hole part, and one end of the first shaft body extends to exceed the side surface of the second bulged part departing from the first bulged part.

2. The smart watch according to claim 1, wherein, a length of the auxiliary display screen along the peripheral direction of the main body part is ⅕ to ¼ of a length of the main display screen along the peripheral direction of the main body part.

3. The smart watch according to claim 2, wherein after the smart watch is worn on the wrist part, the main display screen is located on the surface of the hand back side of the wrist part, and the auxiliary display screen is located at the radius of the wrist part.

4. The smart watch according to claim 1, wherein, the main display screen comprises a main rigid substrate and a main flexible underlayer arranged on the main rigid substrate;

the auxiliary display screen comprises an auxiliary rigid substrate and an auxiliary flexible underlayer arranged on the auxiliary rigid substrate;

the connection display part comprises a connection flexible underlayer, and the connection flexible underlayer is connected with the main flexible underlayer and the auxiliary flexible underlayer.

5. The smart watch according to claim 4, wherein after the smart watch is worn on the wrist part, the main display screen is located on the surface of the hand back side of the wrist part, and the auxiliary display screen is located at the radius of the wrist part.

6. The smart watch according to claim 4, wherein the main flexible underlayer, the connection flexible underlayer and the auxiliary flexible underlayer are integrally formed.

7. The smart watch according to claim 4, wherein, the main display screen further comprises a main pixel unit formed on the main flexible underlayer;

the auxiliary display screen further comprises an auxiliary pixel unit formed on the auxiliary flexible underlayer;

the main pixel unit comprises a plurality of main display pixels, and the auxiliary pixel unit comprises a plurality of auxiliary display pixels.

8. The smart watch according to claim 7, wherein after the smart watch is worn on the wrist part, the main display screen is located on the surface of the hand back side of the wrist part, and the auxiliary display screen is located at the radius of the wrist part.

9. The smart watch according to claim 7, wherein a connection pixel unit is arranged on the connection flexible underlayer, and the connection pixel unit comprises a plurality of connection display pixels.

10. The smart watch according to claim 9, wherein, each of the main display pixels, the auxiliary display pixels, and the connection display pixels have a same shape and dimensions; or each of the main display pixels and the auxiliary display pixels have a same shape and dimensions, whereas a length of each of the connection display pixels along the peripheral direction of the main body part is less than a length of each of the main display pixels, and a width of each of the connection display pixels along a direction vertical to the peripheral direction of the main body part is greater than or equal to a width of each of the main display pixels.

11. The smart watch according to claim 1, wherein, the third hole comprises a third fixation hole part and a third connection hole part which are coaxially formed, and the cross section of the third fixation hole part is a centrosymmetric equilateral polygon, wherein:

one end of the third fixation hole part is located on the side surface of the third bulged part departing from the fourth bulged part, one end of the third connection hole part is located on the side surface of the third bulged part facing the fourth bulged part, the other end of the third connection hole part is located at the other end of the third fixation hole part, and the cross section of the third connection hole part is circular, or, one end of the third fixation hole part is located on the side surface of the third bulged part facing the fourth bulged part, one end of the third connection hole part is located on the side surface of the third bulged part departing from the fourth bulged part, the other end of the third connection hole part is located at the other end of the third fixation hole part;

the fourth hole comprises a fourth fixation hole part and a fourth connection hole part which are coaxially arranged, one end of the fourth fixation hole part is located on the side surface of the fourth bulged part facing the third bulged part, and the cross section of the fourth fixation hole part is a centrosymmetric equilateral polygon, one end of the fourth connection hole part is located on the side surface of the fourth bulged part departing from the third bulged part, the other end of the fourth connection hole part is located at the other end of the fourth fixation hole part, and the cross section of the fourth connection hole part is circular; and the second connection shaft comprises a second shaft body, and a third fixation element and a fourth fixation element which are fixed on the second shaft body, a diameter of the second shaft body is less than that of the third connection hole part and is less than that of the fourth connection hole part, the shapes of the third fixation element and the third fixation hole part are matched, the shapes of the fourth fixation element and the fourth fixation hole part are matched, when the third fixation element is located in the third fixation hole part, the fourth fixation element is located in the fourth fixation hole part, the second shaft body is located in the third connection hole part and the fourth connection hole part, and one end of the second connection shaft extends to exceed the side surface of the fourth bulged part departing from the third bulged part.

12. The smart watch according to claim 1, wherein a transparent cover plate is arranged above the transparent part.

13. The smart watch according to claim 1, further comprising a touch-control panel arranged on the light-outputting surface of the transparent part.

14. The smart watch according to claim 1 wherein after the smart watch is worn on the wrist part, the main display screen is located on the surface of the hand back side of the wrist part, and the auxiliary display screen is located at the radius of the wrist part.

* * * * *